US005970281A

United States Patent [19]

Park

[11] Patent Number: 5,970,281

[45] Date of Patent: Oct. 19, 1999

[54] TRANSFER ROLLER CLEANING APPARATUS OF LIQUID ELECTROGRAPHIC IMAGING SYSTEM

[75] Inventor: Gyeong-ho Park, Suwon, Rep. of Korea

[73] Assignee: Samsung Electronics Co., Ltd., Kyungki-Do, Rep. of Korea

[21] Appl. No.: 09/064,598

[22] Filed: Apr. 23, 1998

[30] Foreign Application Priority Data

Aug. 27, 1997 [KR] Rep. of Korea ..... 97-41604

[51] Int. Cl.[6] ..... G03G 15/14; G03G 21/00

[52] U.S. Cl. ..... 399/101; 399/352

[58] Field of Search ..... 399/308, 327, 399/352, 101

[56] References Cited

U.S. PATENT DOCUMENTS

| | | | |
|---|---|---|---|
| 3,099,856 | 8/1963 | Eichorn et al. | 399/352 X |
| 3,792,925 | 2/1974 | Milligan et al. | 399/352 |
| 4,131,359 | 12/1978 | Honda . | |
| 4,341,455 | 7/1982 | Fedder . | |
| 4,557,588 | 12/1985 | Tomosada et al. | 399/352 |
| 4,568,174 | 2/1986 | Stange | 399/352 |
| 5,070,370 | 12/1991 | Bellis . | |
| 5,510,886 | 4/1996 | Sugimoto et al. | 399/308 |
| 5,715,510 | 2/1998 | Kusaba et al. | 399/308 |

FOREIGN PATENT DOCUMENTS

| | | |
|---|---|---|
| 0 156 510 A1 | 10/1985 | European Pat. Off. . |
| 899627 A1 | 3/1999 | European Pat. Off. . |
| 61-99182 | 5/1986 | Japan . |

*Primary Examiner*—Fred L. Braun

*Attorney, Agent, or Firm*—Sughrue, Mion, Zinn, Macpeak & Seas PLLC

[57] ABSTRACT

A transfer roller cleaning apparatus of an electrographic imaging system. A driving roller and a driven roller are rotatably installed in a main body of the electrographic imaging system. A cleaning belt has one end and another end thereof wound around the driving roller and the driven roller, respectively. A guide roller is rotatably installed in the main body of the system to support the cleaning belt between the driving roller and the driven roller. An actuator reciprocates the guide roller with respect to a transfer roller to allow the cleaning belt supported by the guide roller to selectively contact the surface of the transfer roller. Therefore, left-over toner or foreign material stuck to the surface of the transfer roller can be easily and rapidly removed.

6 Claims, 5 Drawing Sheets

TRANSFER ROLLER CLEANING APPARATUS OF LIQUID ELECTROGRAPHIC IMAGING SYSTEM

BACKGROUND OF THE INVENTION

1. Field of the Invention

The present invention relates to a liquid electrographic imaging system, and more particularly, to a transfer roller cleaning apparatus of a liquid electrographic imaging system which removes left-over developing solution and foreign materials stuck to the surface of a transfer roller which transfers a developed image formed on a photosensitive medium to paper.

2. Description of the Related Art

A liquid electrographic imaging system prints a desired image by developing a latent electrostatic image formed on a photosensitive medium such as a photosensitive belt, by using a developing solution, which is a mixture of a volatile liquid carrier and toner, and transfers the developed image onto paper.

FIG. 1 schematically shows the structure of a conventional liquid electrographic color imaging system. Referring to the drawing, a photosensitive belt 110 operates by being supported by a plurality of rollers 121, 122 and 123. Electrostatic charges remaining on the photosensitive belt 110 are removed by an erasure station 170 and the surface of the photosensitive belt 110 is charged by a charging station 150 to a constant electric potential. Next, an electrostatic latent image is formed on the photosensitive belt 110 as laser scanning units 130 emit laser beams according to image signals. The formed electrostatic latent image is developed by a developing station 140 which supplies a developing solution containing toner. As shown in the drawing, a plurality of laser scanning units 130 and developing stations 140 are equipped to handle a multitude of colors for a color imaging system.

The developing station 140, as shown in FIG. 2, includes a developer roller 141, a cleaning roller 142 and squeegee rollers 144 and 146 which are installed under the photosensitive belt 110, and a developing solution 148 which is a mixture of toner having a predetermined color, and a liquid carrier. Reference numeral 143 represents a developing solution supplier for supplying the developing solution 148 between the developing roller 141 and the photosensitive belt 110.

The squeegee rollers 144 and 146 remove the liquid carrier among a developing solution 148L attached to the electrostatic latent image of the photosensitive belt 110 and the removed liquid carrier is collected in the developing station 140 by blades 145 and 147.

The developing solution 148L attached to the photosensitive belt 110 according to the electrostatic latent image is evaporated as it passes through an image drying station 160, to thereby leave evaporated toner 148D only.

Next, when the photosensitive belt 110 passes between the roller 121 (see FIG. 1) and the transfer roller 124, the image formed by the toner 148D attached to the photosensitive belt 110 is transferred via the transfer roller 124 to a paper 126 supplied between the transfer roller 124 and a fixation roller 125, so that the image is finally printed.

However, although the printing of an image to the paper 126 is complete, a small amount of toner remains on the transfer roller 124. Also, foreign materials such as dust brought into the inside of the imaging system may stick to the transfer roller 124. Such remaining toner or foreign material contribute to lowering the print quality through repeated print processes.

SUMMARY OF THE INVENTION

To solve the above problem, it is an objective of the present invention to provide a transfer roller cleaning apparatus of an electrographic imaging system which removes the small amounts of toner or foreign material attached to the surface of a transfer roller.

Accordingly, to achieve the above objective, there is provided a transfer roller cleaning apparatus of an electrographic imaging system which comprises a driving roller and a driven roller rotatably installed in a main body of the system, a cleaning belt having one end and the other end thereof wound around the driving roller and the driven roller, respectively, a guide roller rotatably installed in the main body of the system for supporting the cleaning belt between the driving roller and the driven roller, and actuating means for reciprocating the guide roller with respect to a transfer roller to allow the cleaning belt supported by the guide roller to selectively contact the surface of the transfer roller.

It is preferable in the present invention that the transfer roller cleaning apparatus further comprises a housing in which the driving roller, driven roller, and guide roller are installed, a first motor for transferring a rotational force to the driving roller, a second motor coupled to rotate the driven roller, and a controller for controlling the first and the second motors, an elastic member coupled to and elastically biasing the housing so that the housing retreats from the transfer roller, and an actuator controlled by the controller to advance the housing toward the transfer roller.

According to another preferred embodiment of the present invention, there is provided a transfer roller cleaning apparatus comprising an elastic member coupled to the housing and biasing the housing to retreat from the transfer roller, and a cam controlled by the controller to advance the housing toward the transfer roller.

It is preferable in the present invention that the transfer roller cleaning apparatus further comprises a pinion gear combined to an output shaft of the first motor, a first pulley engaged with the pinion gear, a second pulley connected by the first pulley and a timing belt, and a connection gear installed to be engaged with the second pulley and for transmitting a rotational force of the first motor by being selectively engaged with the driving roller, in which a sensor for detecting an end mark indicated on one end of the cleaning belt is further comprised, and the actuator is driven by the controller according to a detection signal of the sensor to retreat the housing so that the driving roller and the connection gear are separated from one another.

According to yet another preferred embodiment of the present invention, there is provided a transfer roller cleaning apparatus in which the housing is pivotally installed in the main body of the system.

It is preferable in the present invention that the transfer roller cleaning apparatus further comprises an elastic member coupled to the housing for biasing the housing to pivot, such that the housing can separate from the transfer roller, and an actuator controlled by the controller for pivoting the housing toward the transfer roller.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
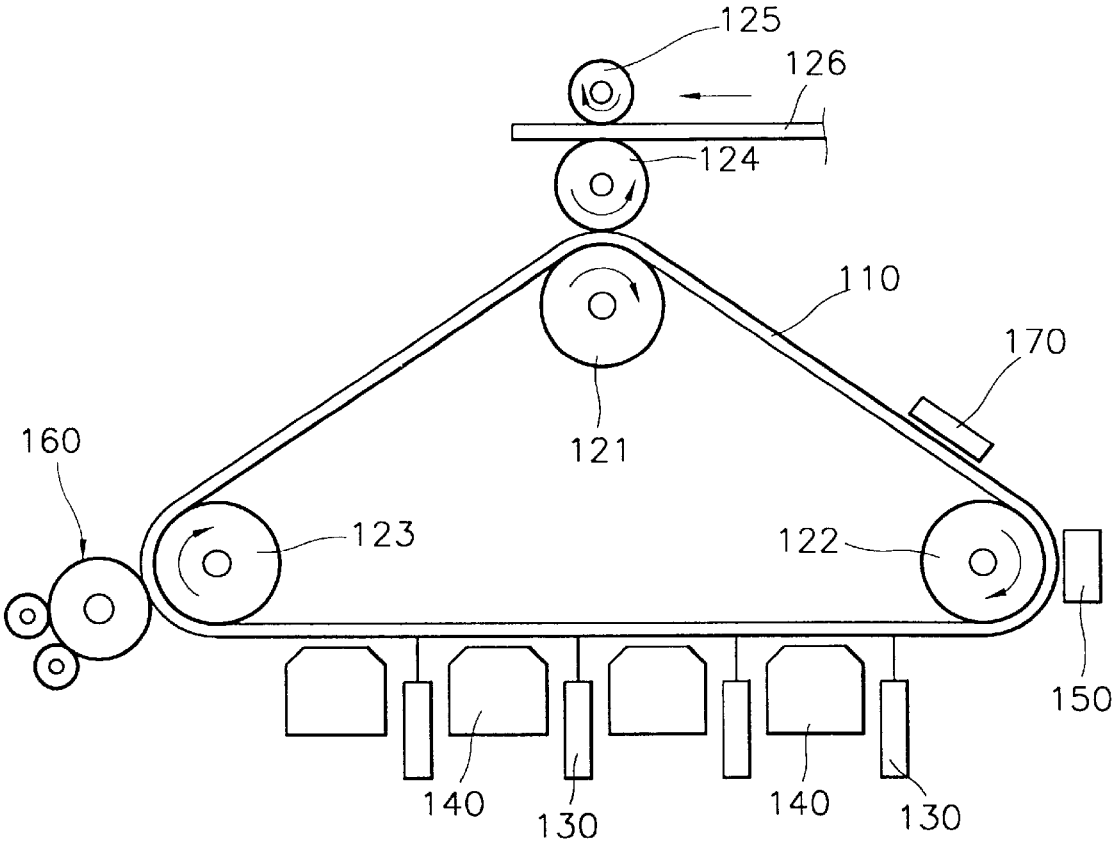
FIG. 1 (PRIOR ART)
FIG. 1 is a view illustrating the overall structure of a conventional liquid electrographic imaging system.
Figure 2:
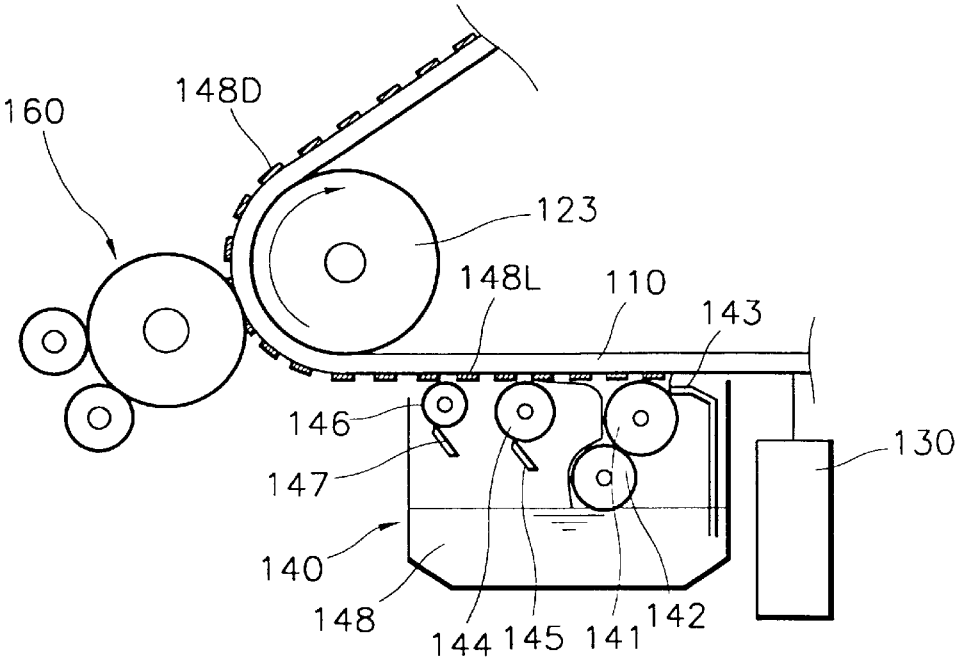
FIG. 2 (PRIOR ART)
FIG. 2 is a view for explaining the developing station shown in FIG. 1.
Figure 3:
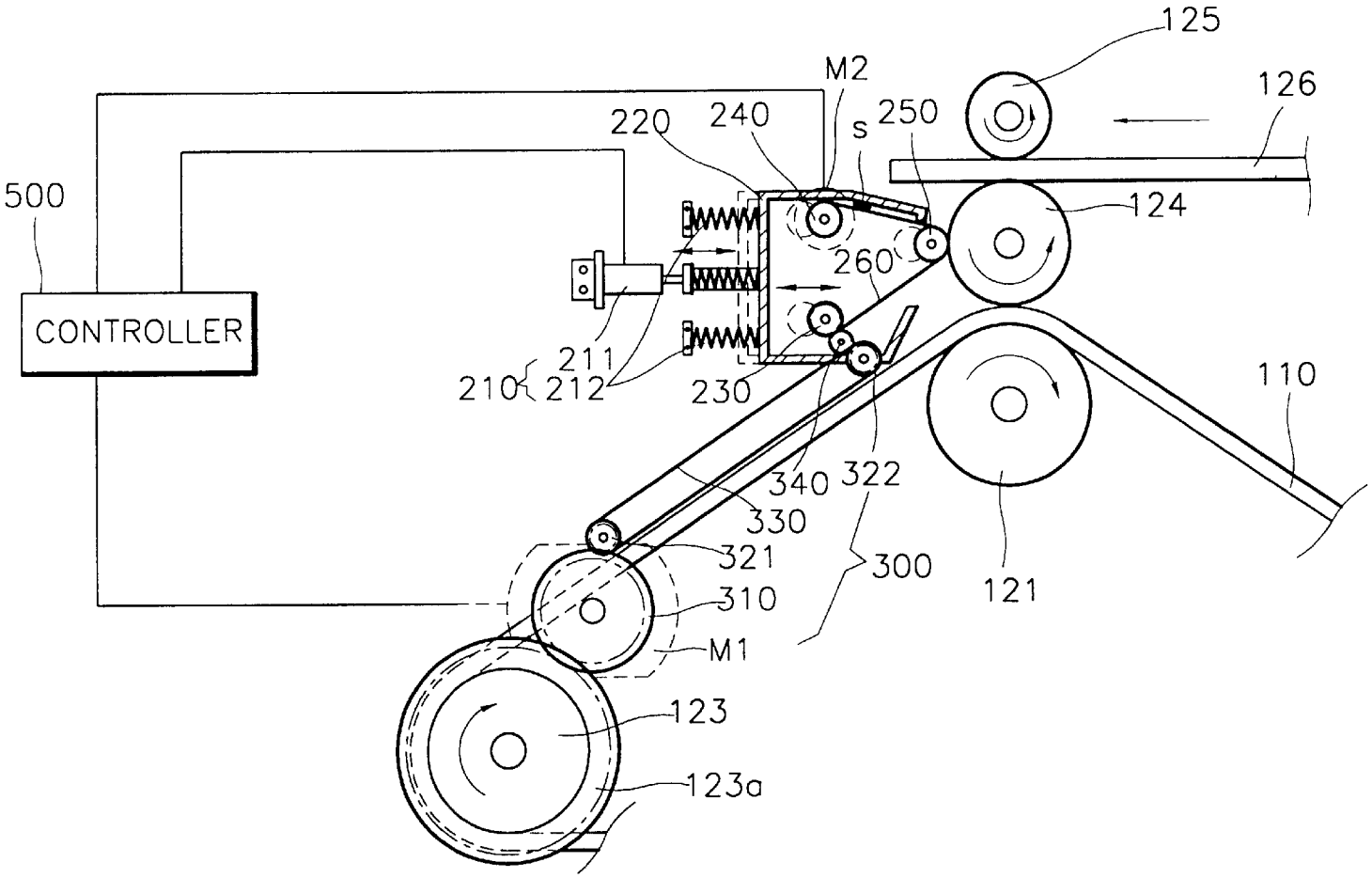
FIG. 3 is a view illustrating a transfer roller cleaning apparatus of a liquid electrographic imaging system according to a preferred embodiment of the present invention.
Figure 4:
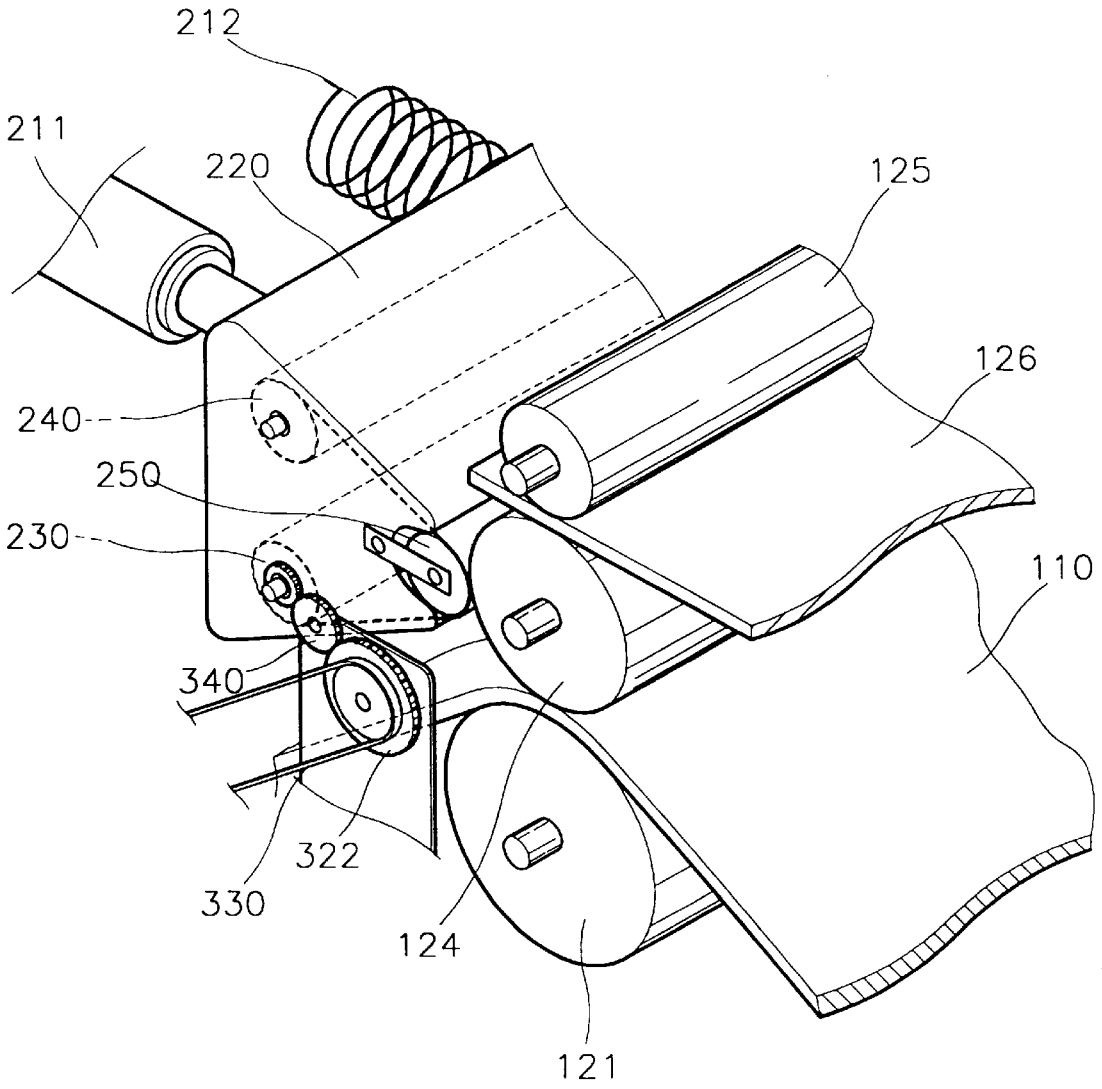
FIG. 4 is a perspective view illustrating a portion of the apparatus shown in FIG. 3.

Referring to FIGS. 3 and 4, a transfer roller cleaning apparatus of a liquid electrographic imaging system according to a preferred embodiment of the present invention will be described. Here, the same reference numerals as those shown in previous drawings indicate the same elements.

As shown in the drawings, the apparatus of the present invention includes a housing 220 and an actuating means 210 for reciprocating the housing 220 with respect to the transfer roller 124. A plurality of rotation rollers 230, 240 and 250 are rotatably installed in the housing 220 and the rotation rollers 230, 240 and 250 are driven by a driving portion 300. Also, a cleaning belt 260 which is supported by the rotation rollers 230, 240 and 250 selectively contacts the transfer roller 124 and cleans the surface thereof according to the movement of the housing 220. The cleaning belt 260 travels by the rotation of the rotation rollers 230, 240 and 250 in the same direction as the rotational direction of the transfer roller 124.

The actuating means 210 is fixed to both the main body of the system (not shown) and the housing 220, and comprises an elastic member 212 such as a tension spring, for elastically biasing the housing 220 to retreat with respect to the transfer roller 124 and an actuator 211 such as a solenoid or a cylinder for advancing the housing 220 toward the transfer roller 124. Accordingly, the housing 220 can advance and retreat with respect to the transfer roller 124 by the driving force of the actuator 211 and the restoration force of the elastic member 212, respectively. Alternatively, the housing 220 can be moved by being driven only by the actuator 211 without the elastic member 212. Also, the actuator 211 is connected by a controller 500 and controlled through a control panel (not shown) which is installed in the main body of the system and connected to the controller 500.

The rotation rollers are comprised of a driving roller 230 winding one end of the cleaning belt 260 which is interlinked with a driving portion 300, a driven roller 240 winding the other end of the cleaning belt 260, and a guide roller 250 which is installed between the driving roller 230 and the driven roller 240 to support the cleaning belt 260 and selectively contacts the transfer roller 124.

The driving portion 300 is comprised of a driving motor M1 having an output shaft combined with a pinion gear 310, a first pulley 321 engaged with the pinion gear 310, a second pulley 322 combined with the first pulley 321 via a timing belt 330, and a connection gear 340 installed to be engaged with the second pulley 322 and selectively engaged with the driving roller 230 according to the movement of the housing 220.

According to the present invention, the pinion gear 310 is installed to be engaged with a driving gear 123*a* installed to be coaxial with the roller 123 for running the photosensitive belt 110. Thus, both the photosensitive belt 110 and the cleaning belt 260 are driven by a single driving motor M1. Also, the driving motor M1 connected to the controller 500 is controlled by manipulating the control panel.

Reference numeral M2 represents a driving motor which is installed in the housing 220 and has an output shaft combined with the driven roller 240, and is connected and controlled by the controller 500. Reference numeral S represents a sensor for recognizing an end mark (not shown) which is marked at the end portion of the cleaning belt 260, and is installed in the housing 220 by being connected to the controller 500.

The transfer roller cleaning apparatus having the above structure according to the present invention cleans the transfer roller as follows.

When a cleaning switch of the control panel (not shown) is turned on by an operator, the controller 500 drives the actuator 211 to advance the housing 220 toward the transfer roller 124. Accordingly, the guide roller 250 advances toward the transfer roller 124 and thus the cleaning belt 260 supported by the guide roller 250 contacts the surface of the transfer roller 124. Concurrently, since the driving roller 230 is rotated by being engaged with the connection gear 340, the cleaning belt 260 is released from the driven roller 240, and runs toward and is wound around the driving roller 230. At this time, the surface of the transfer roller 124 is cleaned.

When the cleaning process is completed as the cleaning belt 260 is wound a predetermined amount around the driving roller 230, the sensor S detects the first end mark (not shown) indicated on the one portion of the cleaning belt 260 and transmits a detection signal to the controller 500. The controller 500 drives the actuator 211 according to the received signal such that the housing 220 retreats from the transfer roller 124. Accordingly, the guide roller 250 is separated from the transfer roller 124, and simultaneously, the driving roller 230 and the connection gear 340 are separated from each other, to thereby stop the operation of the cleaning belt 260. Then, the controller 500 stops the printing process by stopping the operation of the driving motor M1 to thus halt the operation of the photosensitive belt 110.

Next, the controller 500 controls the driving motor M2 to reverse the rotation of the driven roller 240 so that the cleaning belt 260 wound around the driving roller 230 is rewound around the driven roller 240. At this time, the sensor S detects the second end mark (not shown) indicated on the other end portion of the cleaning belt 260 and transmits the detection signal to the controller 500. The controller 500 stops the operation of the driving motor M2 according to the detection signal so that rewinding of the cleaning belt 260 is completed. By repeating the above processes, the transfer roller 124 can be continuously cleaned.

Here, the driving motor M2 can be structured to reverse the rotation of the driven roller 240 upon direction of the controller 500 when the cleaning process of the cleaning belt 260 stops as above. Alternatively, it may be possible to reverse the rotation of the driven roller 240 by operating a rewind switch (not shown) on the control panel (not shown).

Preferably, the driven roller 240 which is wound by the cleaning belt 260 is detachably installed in the housing 220 so that the driven roller can be replaced by another driven roller wound with a new cleaning belt after a predetermined number of cleaning operations.

The cleaning of the transfer roller 124 by the cleaning apparatus of the present invention may be performed periodically. That is, by detecting the mark (not shown) indicated on the photosensitive belt 110 or the transfer roller 124 by a sensor (not shown) additionally installed in the housing 220 or the main body of the system, the detection signal can be transmitted to the controller 500 so that the period for printing particular sheets of papers can be measured. Thus, after a predetermined period, i.e., after printing of particular sheets of paper is completed, the transfer roller 124 can be cleaned by the cleaning apparatus as described above.

Figure 5:
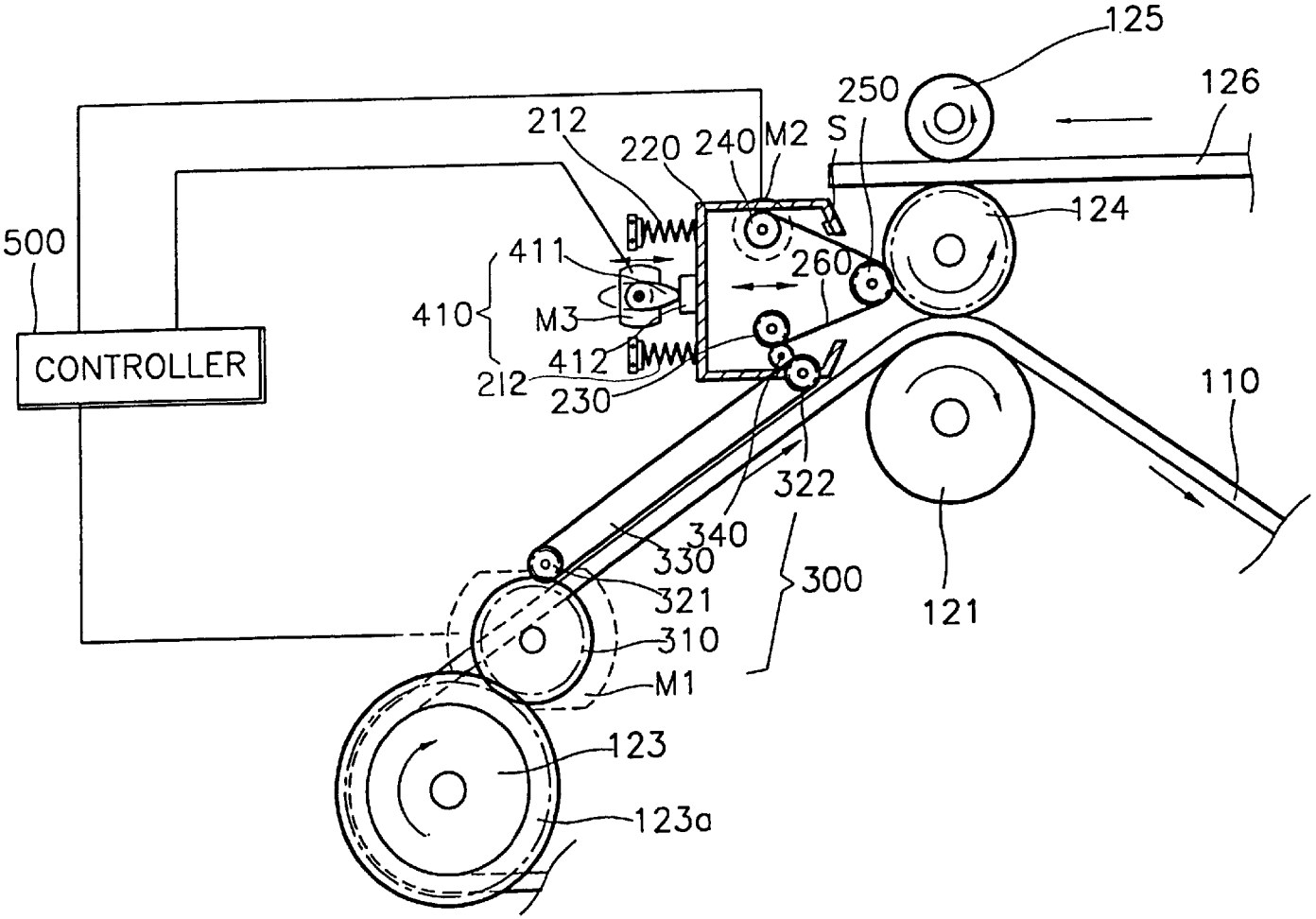
FIG. 5 is a view illustrating a transfer roller cleaning apparatus of a liquid electrographic imaging system according to another preferred embodiment of the present invention.

FIG. 5 shows a transfer roller cleaning apparatus of a liquid photographic imaging system according to another embodiment of the present invention. Here, the same reference numerals as shown in FIG. 3 indicate the same members.

According to the present embodiment, an actuating means 410 is comprised of a cam 411 which is combined to an output shaft of a driving motor M3 installed in the main body of the system (not shown) to connect to the controller 500 and a cam follower 412 which is installed in the housing 220 to contact and engage with the cam 411.

The housing 220 advances and retreats with respect to the transfer roller 124 by interlocking between the cam 411 and the cam follower 412. That is, when a longer edge of the cam 411 rotated by the driving motor M3 presses the cam follower 412, the housing 200 advances toward the transfer roller 124. Whereas when a shorter edge of the cam 411 contacts the cam follower 412, the housing 200 retreats from the transfer roller 124 due to the restoration force of the elastic members 212. Here, it is preferable that the driving motor M3 is step-driven.

Figure 6:
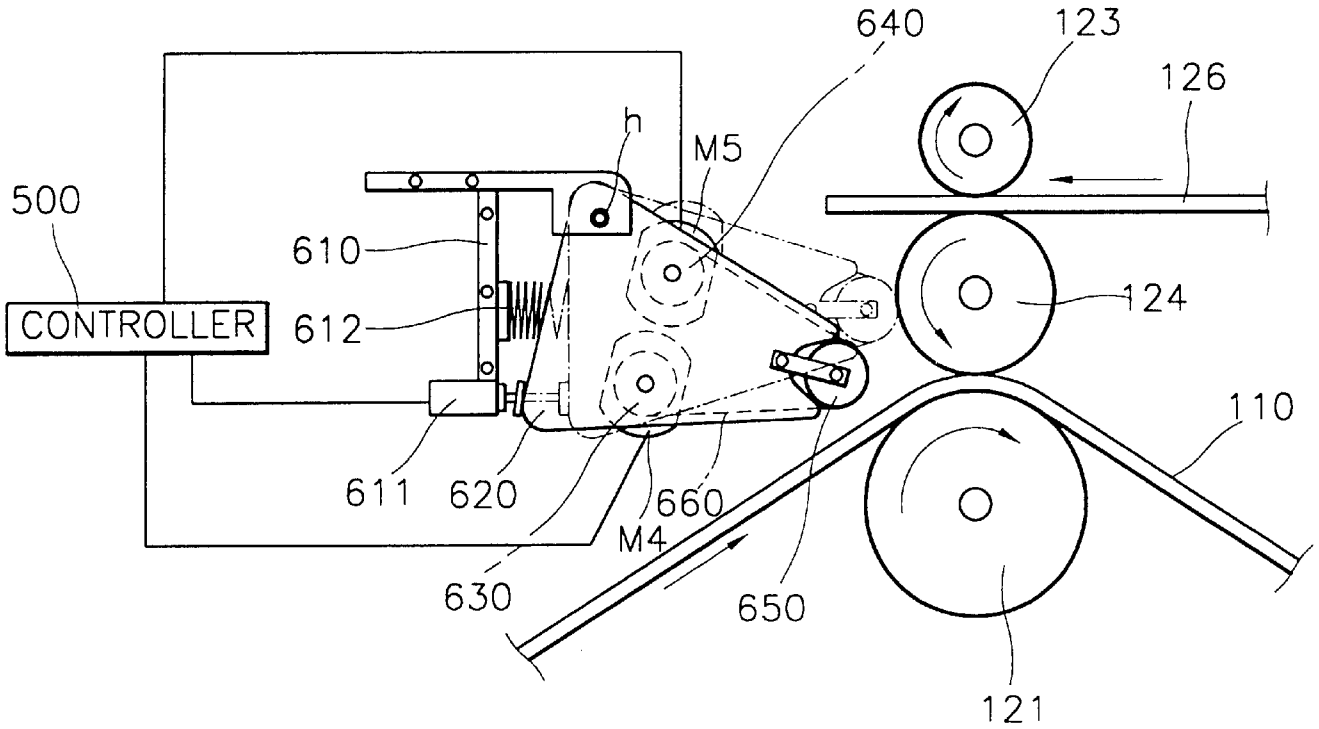
FIG. 6 is a view illustrating a transfer roller cleaning apparatus of a liquid electrographic imaging system according to yet another preferred embodiment of the present invention.

FIG. 6 shows a transfer roller cleaning apparatus of a liquid photographic imaging system according to yet another embodiment of the present invention. Here, the same reference numerals as shown in FIG. 3 indicate the same members.

As shown in the drawing, a housing 620 is installed in the main body of the system (not shown) to be capable of pivoting around a hinge shaft "h". In the housing, there is a driving roller 630 winding one end of a cleaning belt 660, a driven roller 640 winding the other end of the cleaning belt 660, and a guide roller 650 supporting the cleaning belt 660 and selectively contacting the transfer roller 124 according to the pivot of the housing 620.

The housing 620 is elastically biased by an elastic member 612 such as a tension spring, installed in the main body of the system to pivot in a direction to be separated from the transfer roller 124. Also, the housing 620 is driven by an actuator 611 installed in a support member 610 to be rotated toward the transfer roller 124. Alternatively, the housing 620 can advance and retreat by driving the actuator 611 without the elastic member 612 as described above. The actuator 611 is connected to and controlled by the controller 500 which is connected to a control panel (not shown).

The driving roller 630 and the driven roller 640 are combined with driving motors M4 and M5, respectively, to selectively wind the cleaning belt 660 in a forward or reverse direction.

In the operation of the transfer roller cleaning apparatus according to the present embodiment, the controller 500 drives the actuator 611 to pivot the housing 620. Accordingly, the guide roller 650 advances toward the transfer roller 124 so that the cleaning belt 660 supported by the guide roller 650 contacts the surface of the transfer roller 124. Concurrently, the controller 500 controls the driving motor M4 to rotate the driving roller 630. Accordingly, the cleaning belt 660 is operated and the surface of the transfer roller 124 is cleaned.

When the cleaning is completed, the actuator 611 stops driving according to the operation of the sensor S (see FIG. 3) as described above. Then, the housing 620 pivots to its initial position and thus the guide roller 650 is separated from the transfer roller 124. At this time, the controller 500 stops the driving motor M4 to thereby stop the cleaning belt 660 from running. Also, the controller 500 stops the photosensitive belt 110 from running.

Next, the controller controls the driving motor M5 to reverse the rotation of the driven roller 640 so that the cleaning belt 660 wound around the driving roller 630 is rewound. After the cleaning belt 660 is completely rewound, the driving motor M5 stops as in the above-described mechanism.

As described above, in the transfer roller cleaning apparatus of a liquid electrographic imaging system according to the present invention, left-over toner or foreign material stuck to the surface of the transfer roller can be easily and rapidly removed, thereby improving the quality of print.

It is noted that the present invention is not limited to the preferred embodiments described above, and it is apparent that variations and modifications by those skilled in the art can be effected within the spirit and scope of the present invention as defined in the appended claims.

What is claimed is:

1. A transfer roller cleaning apparatus for cleaning a transfer roller of an electrophotographic imaging system, comprising:

a driving roller and a driven roller rotatably installed in a main body of said system;

a cleaning belt having one end and the other end thereof wound around said driving roller and said driven roller, respectively;

a guide roller rotatably installed in the main body of said system for supporting said cleaning belt between said driving roller and said driven roller;

actuating means, moving in a horizontal direction, for reciprocating said guide roller with respect to said transfer roller to allow said cleaning belt supported by said guide roller to selectively contact a surface of said transfer roller;

a housing in which said driving roller, driven roller, and guide roller are installed;

a first motor for transferring a rotational force to said driving roller;

a second motor coupled to rotate said driven roller;

a controller for controlling said first and second motors;

an elastic member coupled to said housing and biasing said housing in a horizontal direction to retreat from said transfer roller; and a cam controlled by said controller to advance said housing in a horizontal direction toward said transfer roller.

2. The transfer roller cleaning apparatus as claimed in claim 1, further comprising:

a cam follower installed in said housing for engaging with said cam.

3. A transfer roller cleaning apparatus for cleaning a transfer roller of an electrophotographic imaging system, comprising:

a driving roller and a driven roller rotatable installed in a main body of said system;

a cleaning belt having one end and the other end thereof wound around said driving roller and said driven roller, respectively;

a guide roller rotatably installed in the main body of said system for supporting said cleaning belt between said driving roller and said driven roller;

actuating means for reciprocating said guide roller with respect to said transfer roller to allow said cleaning belt supported by said guide roller to selectively contact a surface of said transfer roller;

a housing in which said driving roller, driven roller, and guide roller are installed;

a first motor for transferring a rotational force to said driving roller;

a second motor coupled to rotate said driven roller;

a controller for controlling said first and second motors;

a pinion gear combined to an output shaft of said first motor;

a first pulley engaged with said pinion gear;

a second pulley connected by said first pulley and a timing belt; and a connection gear installed to be engaged with said second pulley and for transmitting a rotational force of said first motor by being selectively engaged with said driving roller.

4. The transfer roller cleaning apparatus as claimed in claim 3, further comprising:

a sensor for detecting an end mark indicated on one end of said cleaning belt;

wherein said actuating means is driven by said controller according to a detection signal of said sensor to retreat said housing so that said driving roller and said connection gear are separated from one another.

5. The transfer roller cleaning apparatus as claimed in claim 4, wherein a driving direction of said driven roller is reversed by said second motor to rewind said cleaning belt after completion of a cleaning operation.

6. The transfer roller cleaning apparatus as claimed in claim 3, wherein said driven roller is detachably coupled to said housing.

* * * * *